US006211752B1

(12) United States Patent
Gendraud et al.

(10) Patent No.: US 6,211,752 B1
(45) Date of Patent: Apr. 3, 2001

(54) FILTERING DEVICE WITH METAL CAVITY PROVIDED WITH DIELECTRIC INSERTS

(75) Inventors: Sandra Gendraud, Toulouse; Pierre Guillon; Serge Verdeyme, both of Limoges, all of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/297,665

(22) PCT Filed: Nov. 3, 1997

(86) PCT No.: PCT/FR97/01962

§ 371 Date: Jun. 30, 1999

§ 102(e) Date: Jun. 30, 1999

(87) PCT Pub. No.: WO98/20576

PCT Pub. Date: May 14, 1998

(30) Foreign Application Priority Data

Nov. 5, 1996 (FR) ..... 96/13441

(51) Int. Cl.[7] ..... H01P 1/207
(52) U.S. Cl. ..... 333/208; 333/230; 333/212
(58) Field of Search ..... 333/202, 208, 333/219.1, 227, 212, 209

(56) References Cited

U.S. PATENT DOCUMENTS 3,028,565 4/1962 Walker et al. .
4,721,933 * 1/1988 Schwartz et al. ..... 333/212
5,083,102 1/1992 Zaki .
5,703,547 * 12/1997 Bertin et al. ..... 333/209
6,005,457 * 12/1999 Wu ..... 333/208

FOREIGN PATENT DOCUMENTS 0 351 840 A3 1/1990 (EP) .

OTHER PUBLICATIONS

Y. Kobayashi et al, "A Low Bandpass Filter Using Electrically Coupled High–Q TM01 Dielectric Rod Resonators", IEEE Transactions On Microwave Theory and Techniques, vol. 36, No. 12, Dec. 19, 1988, pp. 1727–1732, XP000035419.

R. Comte et al, "Rigorous Design of a Multimodal Low Losses Microwave Cavity", ESA Workshop On Advanced Cad for Microwave Filters and Passive Devices, Nov. 6–8 1995, pp. 225–231, XP000671423.

* cited by examiner

*Primary Examiner*—Benny Lee
*Assistant Examiner*—Stephen E. Lee
(74) *Attorney, Agent, or Firm*—Sughrue, Mion, Zinn, Macpeak & Seas, PLLC

(57) ABSTRACT

A filter device including a metal cavity (1, 11) closed by two end walls (3*a,* 3*b;* 13, 13*b*) extending transversely relative to the axis of said cavity (1, 11) and at least two dielectric inserts (4*a,* 4*b;* 14*a* to 14*d*) defining a resonator (5, 15*a,* 15*b*) in said cavity, characterized in that it includes at least one coupling iris (7*a,* 7*b;* 17) which also extends transversely relative to said axis.

9 Claims, 2 Drawing Sheets

FILTERING DEVICE WITH METAL CAVITY PROVIDED WITH DIELECTRIC INSERTS

BACKGROUND OF THE INVENTION

The present invention relates to microwave filter devices having a metal cavity with dielectric inserts.

The invention is particularly advantageous when applied to filtering in the field of satellite telecommunications.

Metal cavities have long been used to filter microwaves.

Recent research has shown that loading such metal cavities with transverse inserts in the cavity is beneficial in improving the electrical performance of the resonators constituted by the metal cavities.

In this regard, reference may advantageously be had to the following publications:

[1] R. Comte, S. Verdeyme, P. Guillon, "New concept for low loss microwave devices", Electronics Letters, Vol. 30, No. 5, Mar. 3, 1994, 1995 MTT-S Digest, Orlando, Vol. 3, pp 1535–1538;

[2] R. Comte, S. Verdeyme, P. Guillon, "Rigorous design of multimodal low losses microwave cavity", ESA workshop on advanced CAD for microwave filters and passive devices, 1995, ESTEC, pp 225–231;

[3] R. Comte, S. Gendraud, S. Verdeyme, P. Guillon, C. Boschet, B. Theron, "A high Q factor microwave cavity", 1995, MTT-S Digest, Orlando, Vol. 3, pp 1535–1538.

It might nevertheless still be thought today that, because of the distribution of the field in such cavities with dielectric inserts, they could be coupled to input and output waveguides only via metal coupling irises or coaxial probes on the side walls of the cavities and not on their end walls.

The dielectric inserts distance high electromagnetic fields from the metal end walls of the cavity and thereby confine the energy in the central part of the cavity.

The energy levels are therefore very low in the vicinity of the end walls of the cavity and this is why it might be thought that correct coupling could not be achieved via those walls.

However, a problem arises with coupling via the side walls of the cavity because of coupling of spurious resonant modes in the dielectric inserts, especially for high values of input coupling.

SUMMARY OF THE INVENTION

One aim of the invention is to propose a filter device having a metal cavity with dielectric inserts which solves the above problem and also has particularly satisfactory properties, in particular at high powers.

Because of the distribution of the field in such cavities with dielectric inserts, it might also be thought that it is not possible to couple to each other a plurality of resonators defined in the same metal cavity by a plurality of dielectric inserts.

Another aim of the invention is therefore to propose a metal cavity type device in which the dielectric inserts define a plurality of resonators enabling said device to effect multiple filtering and in which means are provided for coupling the resonators to each other.

The inventors have found that, unexpectedly, transverse metal irises in the end walls of the cavity or inside the cavity, between two resonators defined by dielectric inserts, provide particularly satisfactory coupling and solve the problem caused by coupling of spurious resonant modes in the dielectric inserts.

Accordingly, the invention proposes a filter device including a metal cavity closed by two end walls extending transversely relative to the axis of said cavity and at least two dielectric inserts defining a resonator in said cavity, characterized in that it includes at least one coupling iris which also extends transversely relative to said axis.

The device advantageously includes two coupling irises on respective end walls and which couple said cavity to metal waveguides on said end walls.

It can include a coupling iris extending transversely between two resonators each defined between two dielectric inserts.

BRIEF DESCRIPTION OF THE DRAWINGS

Other features and advantages of the invention emerge further in the course of the following description. The description is purely illustrative and is not limiting on the invention. It is to be read in conjunction with the accompanying drawings, in which.

DETAILED DESCRIPTION OF THE DRAWINGS

Figure 1:
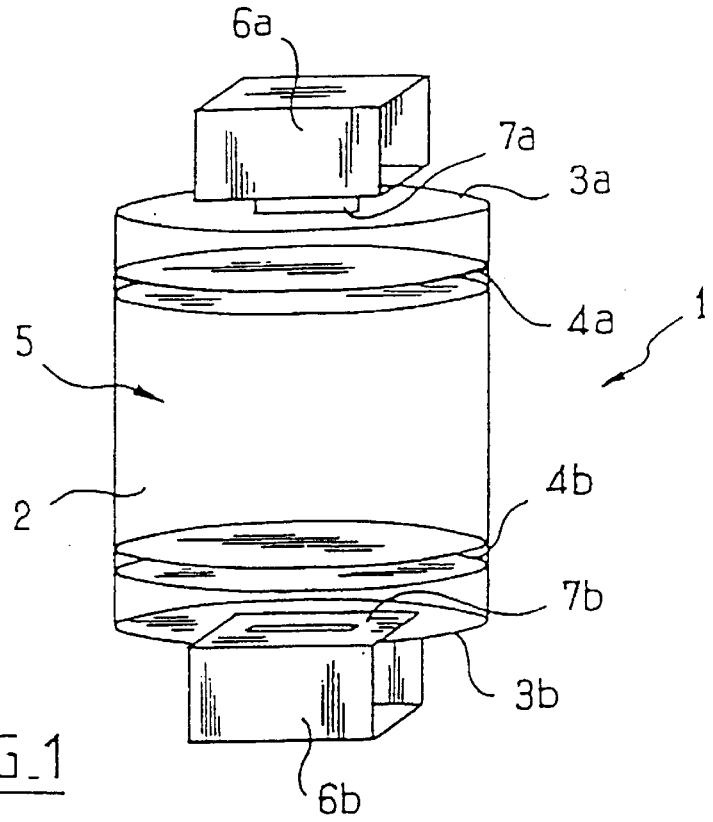
FIG. 1 is a diagrammatic representation of one application of the invention.

The coupling device shown in FIG. 1 includes a cylindrical metal cavity 1.

The cavity 1 is defined by a cylindrical side wall 2 and by two end walls 3*a* and 3*b* which close said cavity 1 and extend transversely relative to its axis.

Two dielectric wafers 4*a* and 4*b* extend transversely in said cavity to define a central resonator 5 therein.

The cavity 1 is coupled to rectangular metal waveguides 6*a,* 6*b* via metal irises 7*a,* 7*b* on the end walls 3*a,* 3*b* of the cavity 1 and concentric with its axis.

Figure 2:
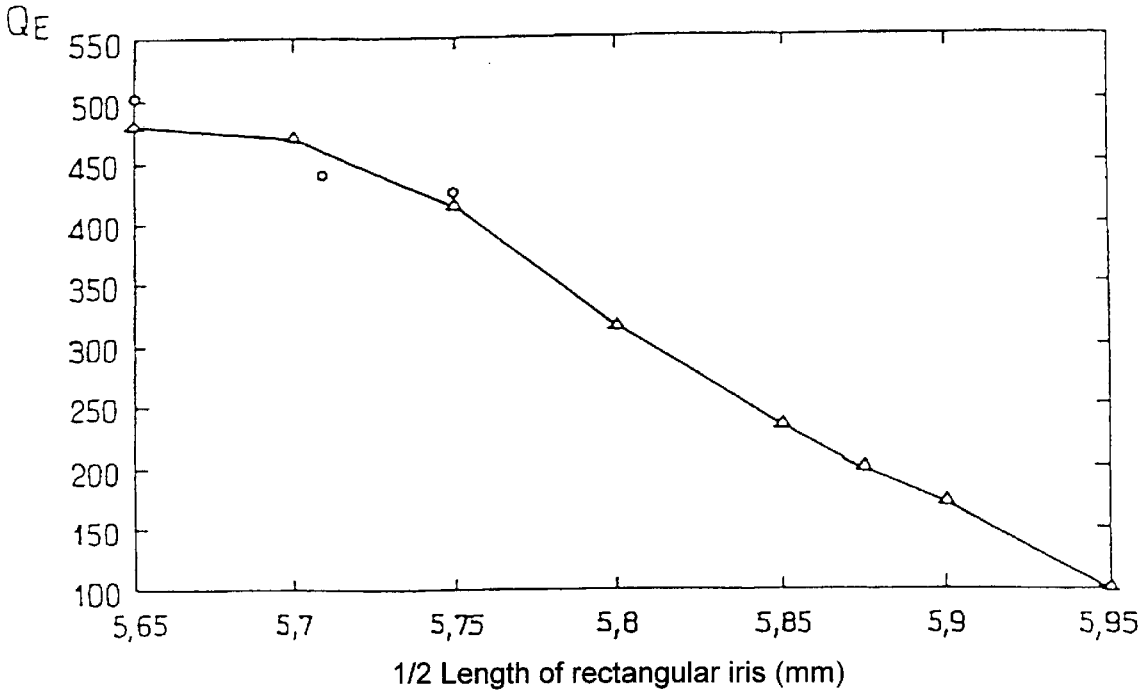
FIG. 2 is a graph of the external coupling coefficient of the device shown in FIG. 1 as a function of the length of the irises of the device.

The FIG. 2 graph gives, for various rectangular coupling iris lengths, values of the external Q factor of a filter device of the type shown in FIG. 1.

From the electrical point of view, a coupling device as shown in FIG. 1 is characterized by:

its Q factor under load $Q_L$, its external Q factor $Q_E$ which is related to coupling between the waveguides and the cavity with dielectric inserts, its no-load Q factor $Q_0$, and the above terms are related by the following equation:

$$Q_L^{-1}=Q_0^{-1}+Q_4^{-1}$$

The values given for $Q_e$ in FIG. 2 correspond to a cylindrical metal cavity 39.7 mm in diameter with 1.92 mm thick sapphire dielectric inserts 4*a,* 4*b,* in which the distance between the dielectric inserts 4*a,* 4*b* and the walls 3*a,* 3*b* is 6.4 mm, the distance between the two dielectric inserts is 12.8 mm, the coupling irises are 2 mm thick, 1 mm wide and of various lengths, and the metal waveguides 6*a,* 6*b* are WG90 type waveguides 22.9 mm high and 10.16 mm wide.

The curve in FIG. 2 on which the points are represented by the symbol Δ is a theoretical curve calculated by simulation. FIG. 2 also shows a number of measurement points represented by the symbol "o" obtained experimentally.

Other types of iris could of course be used, depending on the type of filtering required, in particular cruciform irises.

Equally, the invention is not limited to cylindrical cavities but applies equally to metal cavities with other shapes.

FIG. 2 shows that the experimental measurements agree well with the theoretical results.

Figure 3:
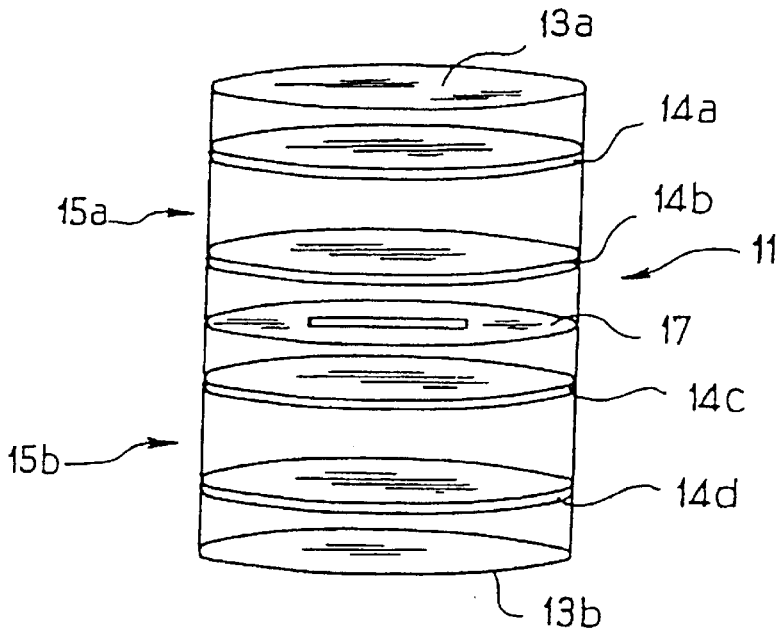
FIG. 3 is a diagrammatic representation of another application of the invention.

FIG. 3 shows a cylindrical metal cavity 11 with a plurality of dielectric inserts 14*a* through 14*d* which define two resonators 15*a,* 15*b* in said cavity 11 spaced apart in the heightwise direction of the cavity.

The two resonators 15*a,* 15*b* are coupled via a metal iris 17 of rectangular, circular or cruciform shape, for example.

For good coupling of the propagating modes, the metal iris 17 is advantageously halfway up the height of the cavity 11 so that said cavity 11 has a symmetrical structure on each side of said metal iris 17.

Figure 4:
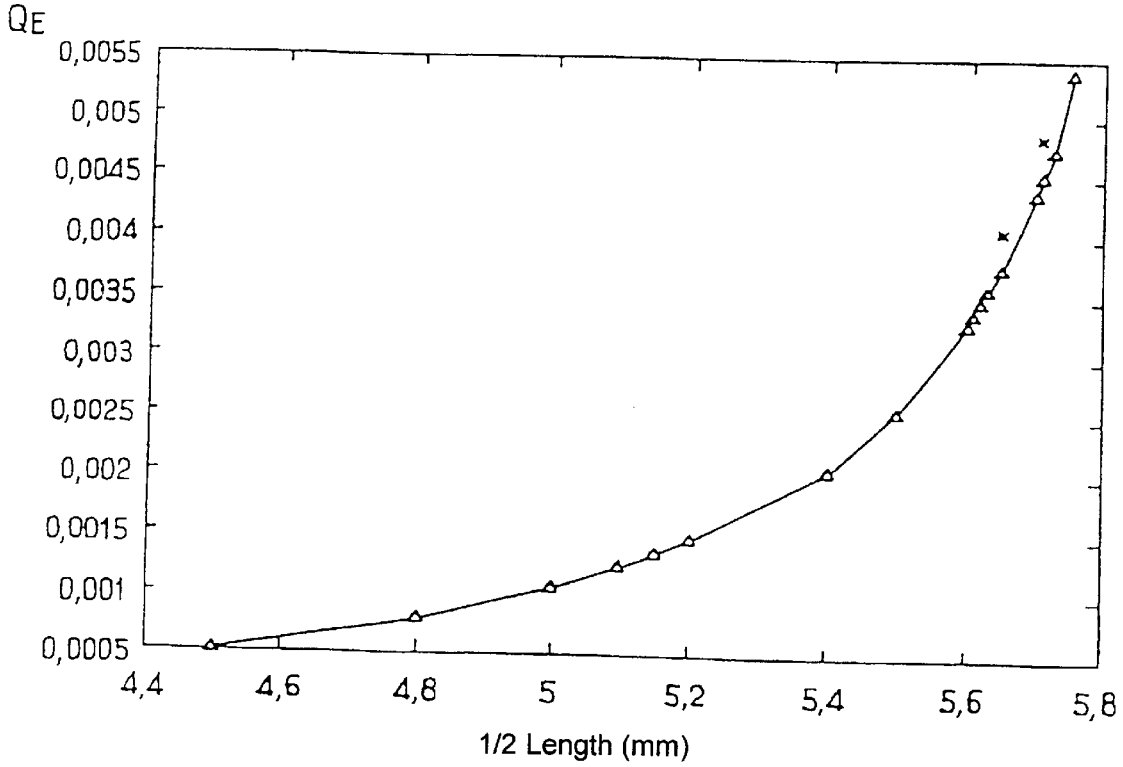
FIG. 4 is a graph of the intercavity coupling coefficient of the device shown in FIG. 3 as a function of the length of the iris of the device.

The FIG. 4 graph shows intercavity coupling values for a structure of the type shown in FIG. 3 with a 39.7 mm diameter metal cavity 11 containing four 1.92 mm thick dielectric inserts 14*a* through 14*d* consisting of sapphire wafers, in which the inserts 14*a* (respectively 14*c*) and 14*b* (respectively 14*d*) are spaced in the heightwise direction by 12.8 mm, the distance in the heightwise direction between the dielectric patches and the metal end walls 13*a,* 13*b* of the cavity 11 or the coupling iris 17 inside the cavity 11 is 6.4 mm, and the coupling iris 17 has a rectangular aperture with a thickness of 2 mm, a width of 1 mm and various lengths.

The curve in FIG. 4 in which the points are represented by the symbol Δ is a theoretical curve calculated by simulation. FIG. 4 also shows a number of measurement points represented by the symbol "o" obtained experimentally.

FIG. 4 shows that the experimental results agree with the simulated results and that the coupling values obtained are similar to those usually encountered in multimode filters.

FIGS. 2 and 4 clearly show that it is possible to modulate the coupling obtained according to the required filtering by varying the length of the iris aperture.

This variation does not lead to coupling of modes of the dielectric inserts and the electromagnetic environment of the inserts is not modified.

The filter devices described have standard coupling values for this type of device and satisfy the usual isolation constraints.

What is claimed is:

1. A filter device including a metal cavity (1, 11) closed by two end walls (3*a,* 3*b;* 13, 13*b*) extending transversely relative to the axis of said cavity (1, 11) and at least two dielectric inserts (4*a,* 4*b;* 14*a* to 14*d*) defining a resonator (5, 15*a,* 15*b*) in said cavity, said device further including at least one coupling iris (7*a,* 7*b;* 17) which also extends transversely relative to said axis, said device being characterized in that said at least one coupling iris is on at least one of said end walls (3*a,* 3*b;* 13, 13*b*) of said cavity (1) and couples said cavity (1) to at least one metal waveguide (6*a,* 6*b*) on said at least one end wall (3*a,* 3*b*).

2. The device according to claim 1 characterized in that said device includes two coupling irises (7*a,* 7*b*) on respective end walls (3*a,* 3*b*) and which couple said cavity (1) to metal waveguides (6*a,* 6*b*) on said end walls (3*a,* 3*b*).

3. The device according to claim 1 characterized in that said device includes a coupling iris (17) extending transversely between two resonators (15*a,* 15*b*) each defined between two dielectric inserts (14*a* to 14*d*).

4. The device according to claim 1 characterized in that said at least one coupling iris (7*a,* 7*b;* 17) is in line with the axis of the cavity.

5. The device according to claim 1, wherein said at least one coupling iris is a metal iris.

6. The device according to claim 2 characterized in that said device includes a coupling iris (17) extending transversely between two resonators (15*a,* 15*b*) each defined between two dielectric inserts (14*a* to 14*d*).

7. The device according to claim 2 characterized in that said at least one coupling iris (7*a,* 7*b;* 17) is in line with the axis of the cavity.

8. The device according to claim 3 characterized in that said at least one coupling iris (7*a,* 7*b;* 17) is in line with the axis of the cavity.

9. The device according to claim 5 characterized in that said at least one coupling iris (7*a,* 7*b;* 17) is in line with the axis of the cavity.

* * * * *